US011808277B2

(12) United States Patent
Sishtla et al.

(10) Patent No.: US 11,808,277 B2
(45) Date of Patent: Nov. 7, 2023

(54) CENTRIFUGAL COMPRESSOR WITH RECIRCULATION PASSAGE

(71) Applicant: Carrier Corporation, Palm Beach Gardens, FL (US)

(72) Inventors: Vishnu M. Sishtla, Manlius, NY (US); William T. Cousins, Glastonbury, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/960,401

(22) Filed: Oct. 5, 2022

(65) Prior Publication Data

US 2023/0025097 A1 Jan. 26, 2023

Related U.S. Application Data

(62) Division of application No. 17/482,526, filed on Sep. 23, 2021, now Pat. No. 11,499,561, which is a (Continued)

(51) Int. Cl.
*F04D 27/02* (2006.01)
*F04D 29/42* (2006.01)
(Continued)

(52) U.S. Cl.
CPC ..... *F04D 27/0207* (2013.01); *F01D 17/162* (2013.01); *F04D 17/14* (2013.01);
(Continued)

(58) Field of Classification Search
CPC .. F04D 27/0207; F04D 27/009; F04D 17/162; F04D 29/284
See application file for complete search history.

(56) References Cited

U.S. PATENT DOCUMENTS 4,248,566 A 2/1981 Chapman et al.
4,708,588 A 11/1987 Schwarz et al.
(Continued)

FOREIGN PATENT DOCUMENTS

CN 1115011 A 1/1996
CN 104019058 A 9/2014
(Continued)

OTHER PUBLICATIONS

Uchiumi, 1997, JP09133098A English Translation (Year: 1997).*
(Continued)

*Primary Examiner* — Michael L Sehn
(74) *Attorney, Agent, or Firm* — Carlson, Gaskey & Olds, P.C.

(57) ABSTRACT

An example centrifugal compressor includes a housing that defines an inlet chamber and includes first and second openings that define a recirculation passage in fluid communication with the inlet chamber. An impeller is disposed within the housing and is rotatable about a longitudinal axis to draw fluid into the inlet chamber. The first and second openings are at different axial locations along the longitudinal axis. A plurality of inlet guide vanes are rotatable and situated in the inlet chamber. The centrifugal compressor includes a ring and a controller for moving the ring along the longitudinal axis between a first position and a second position when rotating the inlet guide vanes. The ring obstructs at least one of the first and second openings more in the second position than in the first position.

10 Claims, 13 Drawing Sheets

Related U.S. Application Data division of application No. 16/272,032, filed on Feb. 11, 2019, now Pat. No. 11,156,226.

(60) Provisional application No. 62/628,364, filed on Feb. 9, 2018.

(51) Int. Cl.

| | |
|---|---|
| ***F04D 29/68*** | (2006.01) |
| ***F01D 17/16*** | (2006.01) |
| ***F04D 17/14*** | (2006.01) |
| ***F04D 27/00*** | (2006.01) |
| ***F04D 29/28*** | (2006.01) |
| ***F25B 31/02*** | (2006.01) |

(52) U.S. Cl.

CPC ..... *F04D 27/001* (2013.01); *F04D 27/009* (2013.01); *F04D 27/0238* (2013.01); *F04D 27/0246* (2013.01); *F04D 29/284* (2013.01); *F04D 29/4213* (2013.01); *F04D 29/685* (2013.01); *F25B 31/026* (2013.01)

(56) References Cited

U.S. PATENT DOCUMENTS

| | | | |
|---|---|---|---|
| 4,981,018 | A | 1/1991 | Jones et al. |
| 5,807,071 | A | 9/1998 | Brasz et al. |
| 6,129,511 | A | 10/2000 | Salvage et al. |
| 6,872,050 | B2 | 3/2005 | Nenstiel |
| 7,475,539 | B2 | 1/2009 | Chen |
| 7,736,126 | B2 | 6/2010 | Joco et al. |
| 7,988,426 | B2 | 8/2011 | Elpern et al. |
| 8,061,974 | B2 | 11/2011 | Gu et al. |
| 8,287,233 | B2 | 10/2012 | Chen |
| 9,719,518 | B2 | 8/2017 | Mohtar et al. |
| 9,732,756 | B2 | 8/2017 | An et al. |
| 2016/0153297 | A1 | 6/2016 | Olds et al. |
| 2016/0195109 | A1 | 7/2016 | Richards |
| 2016/0281732 | A1 | 9/2016 | Lardy et al. |
| 2017/0022999 | A1 | 1/2017 | Peer et al. |
| 2017/0227013 | A1 | 8/2017 | Kumar et al. |
| 2017/0260987 | A1 | 9/2017 | Onodera |

FOREIGN PATENT DOCUMENTS

| | | | | |
|---|---|---|---|---|
| CN | 104428509 | A | | 3/2015 |
| EP | 2896807 | B1 | | 7/2015 |
| EP | 3524824 | A1 | | 8/2019 |
| JP | 09133098 | A | * | 5/1997 |
| JP | 2003106293 | A | | 4/2003 |
| JP | 2006002650 | A | | 1/2006 |
| WO | 2014030248 | A1 | | 7/2016 |

OTHER PUBLICATIONS

Yoshihiro, JP2006002650A English Translation (Year: 2006).*

Guillou, Erwann, "Experimental Investigation of Flow Instability in a Turbocharger Ported Shroud Compressor," Journal of Turbomachinery, http://turbomachinery.asmedigitalcollection.asme.org/article.aspx?articleid=2480255, Jun. 2016, vol. 138.

European Search Report for European Application No. 19152840.5 completed Jun. 5, 2019.

* cited by examiner

CENTRIFUGAL COMPRESSOR WITH RECIRCULATION PASSAGE

CROSS-REFERENCE TO RELATED APPLICATION

This is a divisional application of U.S. application Ser. No. 17/482,526 filed on Sep. 23, 2021, which is a divisional application of U.S. application Ser. No. 16/272,032 filed on Feb. 11, 2019, which claims the benefit of U.S. Provisional Application No. 62/628,364, which was filed on Feb. 9, 2018, the disclosures of each of which are incorporated by reference herein in their entirety.

BACKGROUND

This application relates to centrifugal compressors, and more particularly to a centrifugal compressor with a variable recirculation passage.

Centrifugal compressors are known, and utilize an impeller that rotates about an axis to draw fluid into the compressor and compress the fluid to an outlet. The fluid is directed radially outward from the axis through a diffuser passage that increases a pressure of the fluid to a collector area.

Compressor maps are a known way of charting compressor operating conditions, in which the Y axis represents a pressure ratio and the X axis represents a mass of flow through the compressor. The left-hand boundary of a compressor map represents a surge boundary, and operation to the left of that line represents a region of flow instability. Operation in this region is undesirable because it can cause pressurized refrigerant gas to backflow in a compressor.

Some centrifugal compressors include a ported shroud that surrounds an inlet area of the compressor for providing a recirculation passage. This helps to move the surge line and provide stability at lower load conditions. However, the recirculation passage can cause reduced efficiency at loads away from surge.

SUMMARY

An example centrifugal compressor includes a housing that defines an inlet chamber and includes first and second openings that define a recirculation passage in fluid communication with the inlet chamber. An impeller is disposed within the housing and is rotatable about a longitudinal axis to draw fluid into the inlet chamber. The first and second openings are at different axial locations along the longitudinal axis. A plurality of inlet guide vanes are rotatable and situated in the inlet chamber. The centrifugal compressor includes a ring and a controller for moving the ring along the longitudinal axis between a first position and a second position when rotating the inlet guide vanes. The ring obstructs at least one of the first and second openings more in the second position than in the first position.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
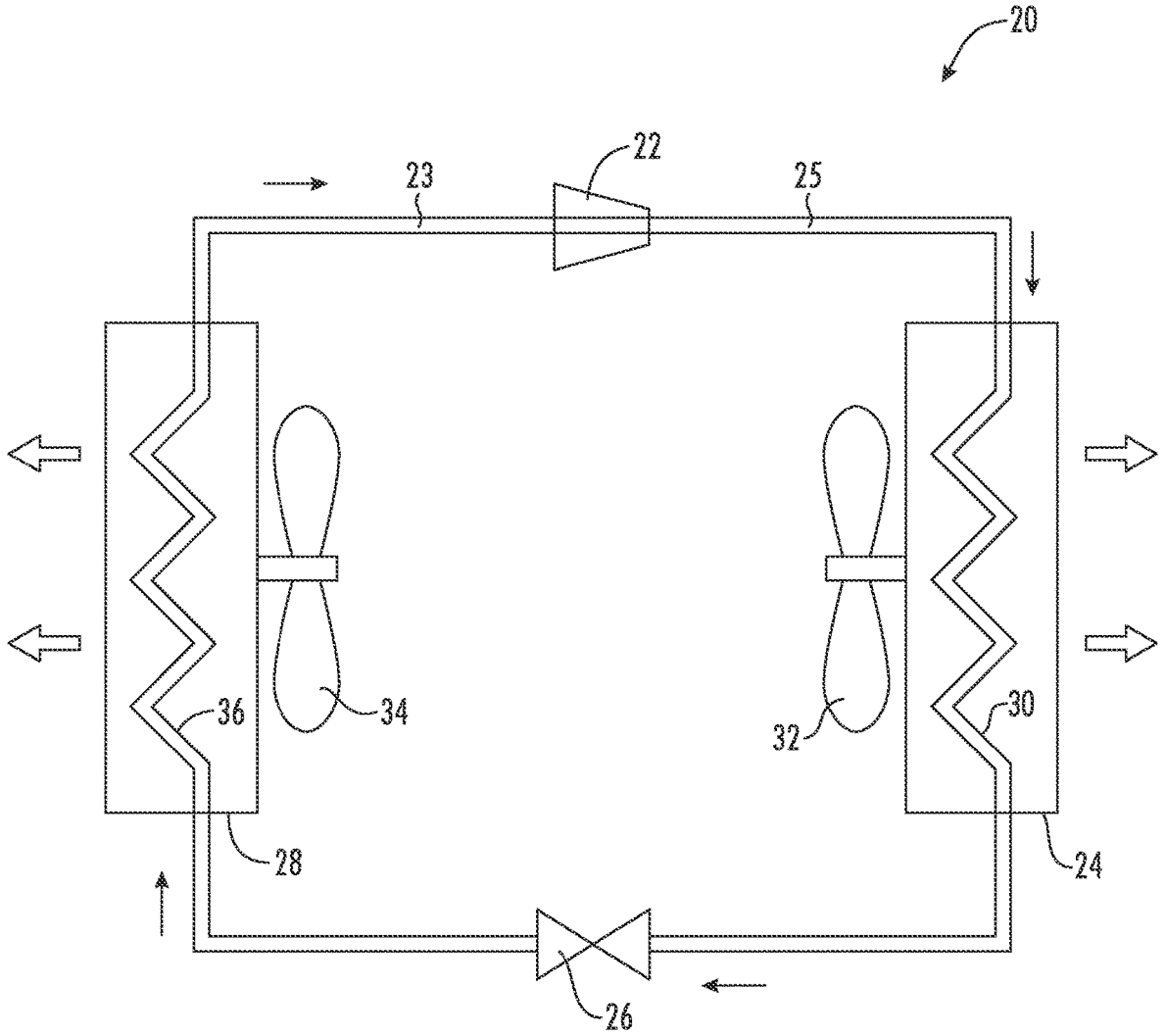
FIG. 1 is a schematic view of an example refrigeration circuit.

FIG. 1 is a schematic view of an example refrigeration circuit 20 that includes a compressor 22, a first heat exchanger 24, an expansion device 26, and a second heat exchanger 28. Refrigerant is compressed in the compressor 22, and exits the compressor 22 at a high pressure and a high enthalpy, and flows to the first heat exchanger 24.

The first heat exchanger 24 operates as a condenser. In the first heat exchanger 24, refrigerant flows through a coil 30 and rejects heat to air that is drawn over the coil 30 by a blower fan 32. In the first heat exchanger 24, refrigerant is condensed into a liquid that exits the first heat exchanger 24 at a low enthalpy and a high pressure. The heat rejection medium could be water in a shell and tube arrangement, for example.

The refrigerant flows from the first heat exchanger 24 to an expansion device 26, such as an expansion valve, that expands the refrigerant to a low pressure. After expansion, the refrigerant flows through the second heat exchanger 28, which operates as an evaporator. A blower fan 34 draws air through the second heat exchanger 28 and over a coil 36. The refrigerant flowing through the coil 36 accepts heat from air, exiting the second heat exchanger 28 at a high enthalpy and a low pressure. The refrigerant then flows to the compressor 22, completing its refrigeration cycle. The cooling medium could be water in a shell and tube arrangement, for example.

Figure 2A:
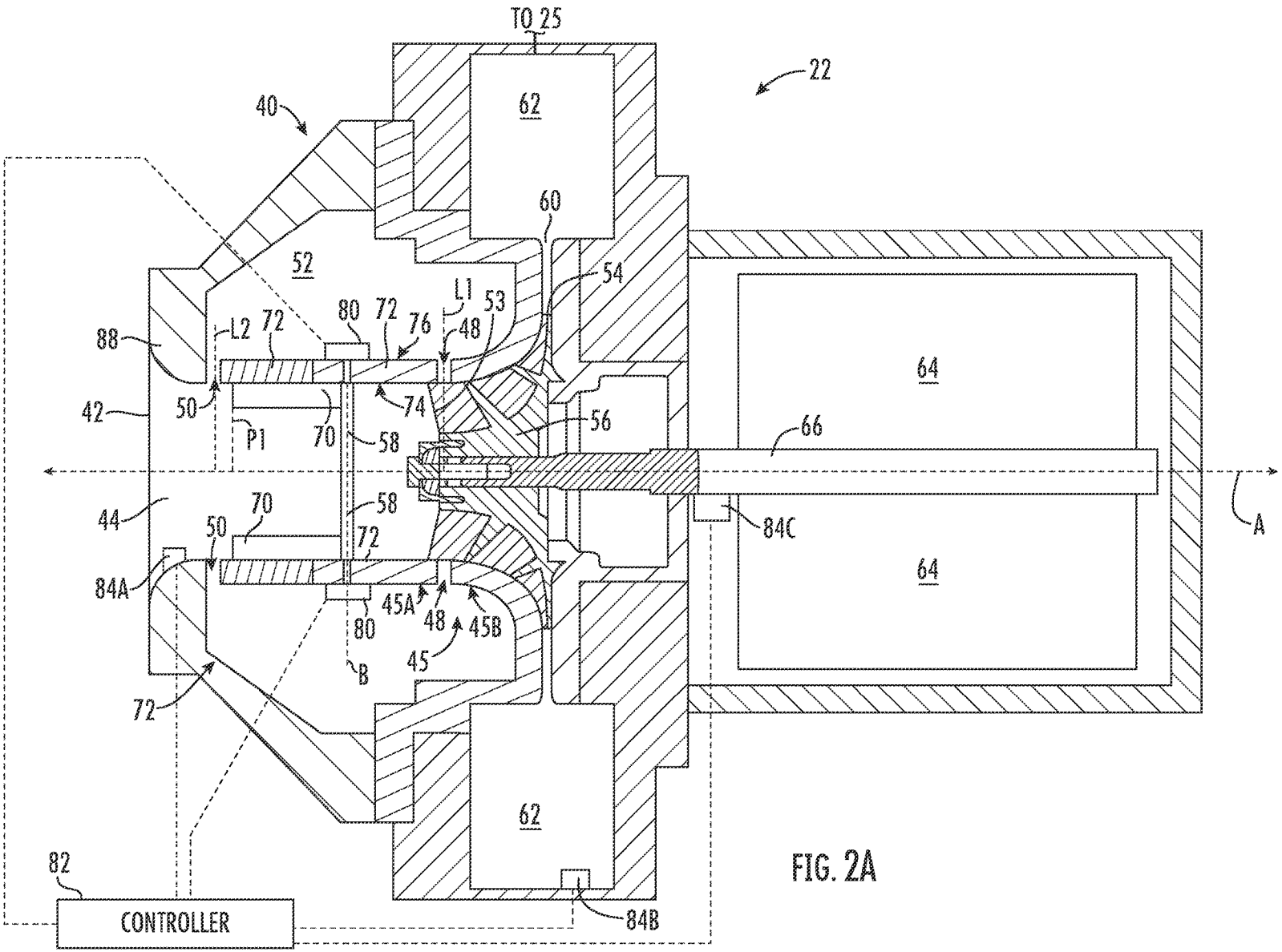
FIG. 2A schematically illustrates an example centrifugal compressor having a first control arrangement for a ring, and a recirculation passage that is open.

FIG. 2A schematically illustrates an example centrifugal compressor 22 that may be used in the refrigeration circuit 20 of FIG. 1. The centrifugal compressor 22 includes a housing 40 that defines an inlet 42, an inlet chamber 44, and includes a ported shroud 45 that surrounds an impeller 56. The housing 40 includes a first opening 48 and a second opening 50 that define a recirculation passage 52 in fluid communication with the inlet chamber 44. In the example of FIG. 2A, the ported shroud 45 and recirculation passage 52 are annular and extend circumferentially around a longitudinal axis A, and the openings 48, 50 extend between the inlet chamber 44 and the recirculation passage 52. Also, in the example of FIG. 2A, the opening 48 is an opening between portions 45A-B of the ported shroud 45.

The impeller 56 is situated within the housing 40 and rotates about the longitudinal axis A to draw fluid through the inlet 42 into the inlet chamber 44. The fluid passes from a fluid line 23 (see FIG. 1) through inlet guide vanes 58 to the impeller 56, and is compressed. The compressed fluid, here a refrigerant, passes through a diffuser passage 60 and into a collector 62. The compressed fluid then passes into line 25 (see FIG. 1). A motor 64 rotates the impeller 56 by rotating a shaft 66 that is collinear with the longitudinal axis A.

The first opening 48 and second opening 50 are located at different axial locations along the longitudinal axis A, with the first opening 48 at location L1 and the second opening 50 at location L2. The second opening 50 is closer to the inlet 42 than the first opening 48. In one example, opening 48 is located between a leading edge 53 and a trailing edge 54 of the impeller 56.

Figure 2B:
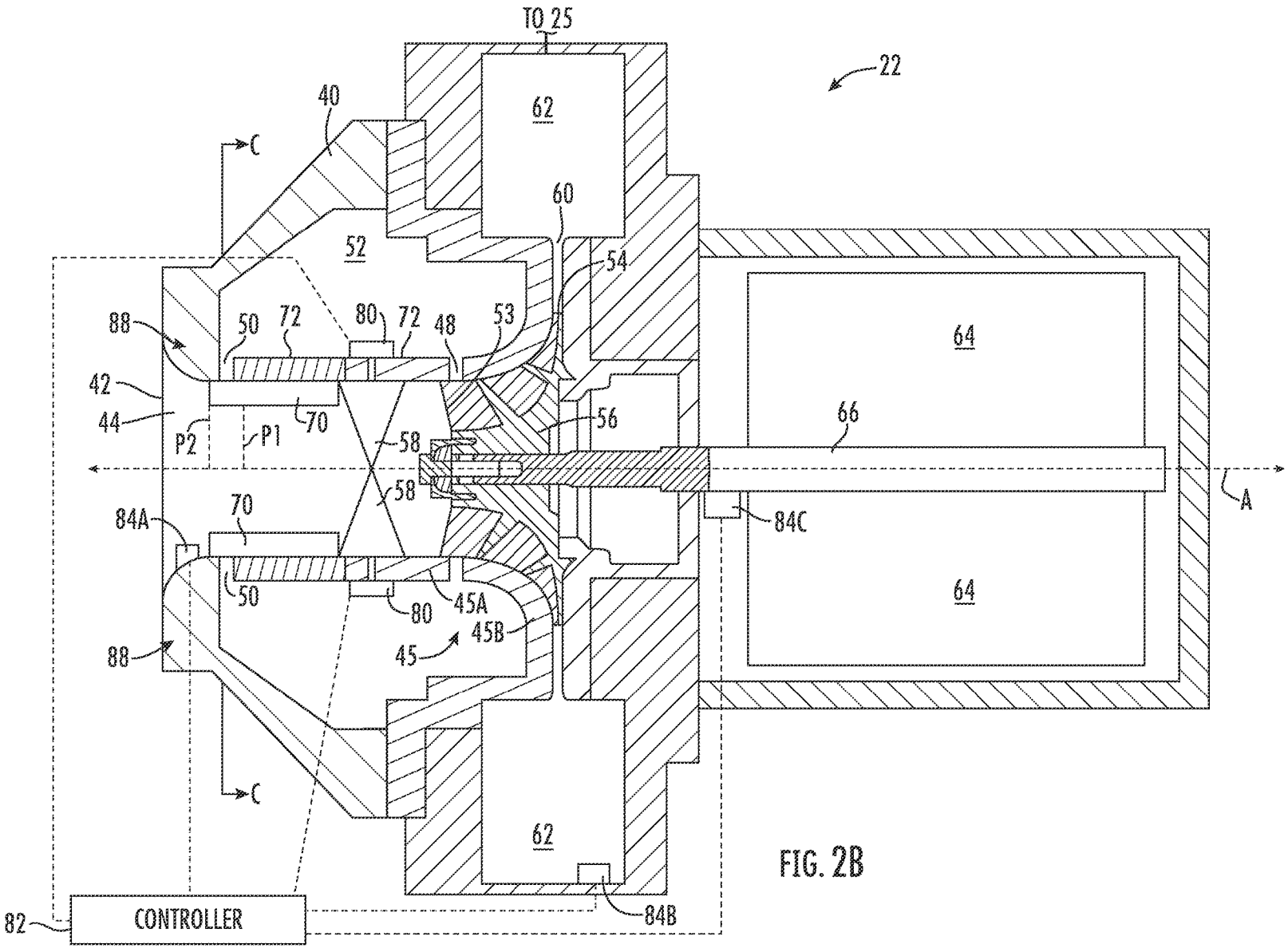
FIG. 2B schematically illustrates the centrifugal compressor of FIG. 2A with its recirculation passage closed.

A ring 70 is movable along the longitudinal axis A between a first position (shown in FIG. 2A) in which a majority of the ring 70 is axially between the first opening 48 and second opening 50, and a second position (shown in FIG. 2B). The ring 70 obstructs the second opening 50 more in the second position than in the first position. Through inclusion of the ring 70, the recirculation passage 52 is variable between different configurations.

A leading edge of the ring 70 in the first position is shown as P1, and a leading edge of the ring 70 in the second position is shown as P2. In the example of FIG. 2A the entire ring 70 is between the first and second openings 48, 50, and in the example of FIG. 2B the entire second opening 50 is obstructed by the ring 70. Of course, other configurations could be used, such as partial obstruction in the first position and greater but not full obstruction in the second position.

A wall 72 separates the inlet chamber 44 from the recirculation passage 52 of the ported shroud 45. In the example of FIGS. 2A-B the ring 70 abuts a radially inner side 74 of the wall 72. The wall 72 includes a portion 45A of the ported shroud 45.

A plurality of the inlet guide vanes 58 extend radially outward from the longitudinal axis A and are rotatable about respective axes of rotation B that extend radially outward from the longitudinal axis A. The inlet guide vanes 58 are rotatable between an open position that maximizes flow (FIG. 2A) and a closed position that minimizes flow (FIG. 2B). In the example of FIGS. 2A-B, the inlet guide vanes 58 are located at an axial location that is between the first axial location L1 and the second axial location L2.

A controller 82 is configured to move the ring 70 along the longitudinal axis A between the first and second positions when the inlet guide vanes 58 rotate. In the example of FIGS. 2A-B, some or all of the inlet guide vanes 58 are mechanically coupled to the ring 70 such that rotation of the inlet guide vanes 58 provides axial movement of the ring 70 along the longitudinal axis A between the first and second positions.

Figure 2C:
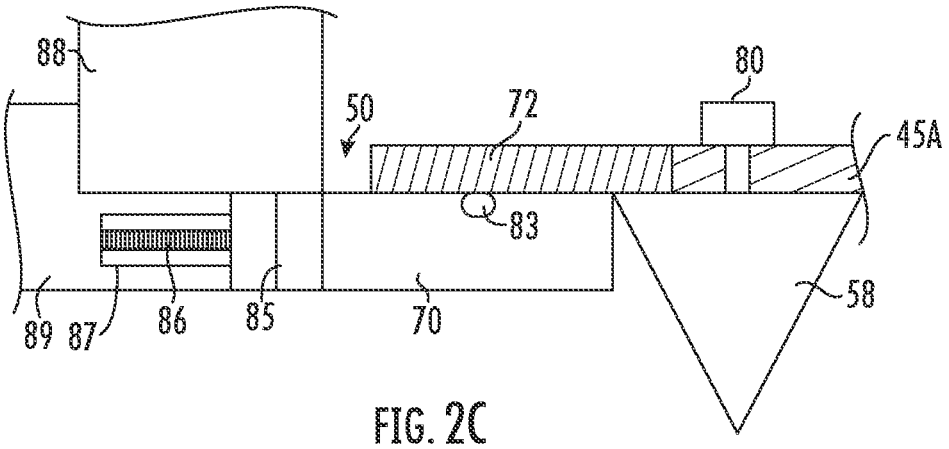
FIG. 2C schematically illustrates an example mechanical coupling between an inlet guide vane and a moveable ring, with the ring in a first position.
Figure 2D:
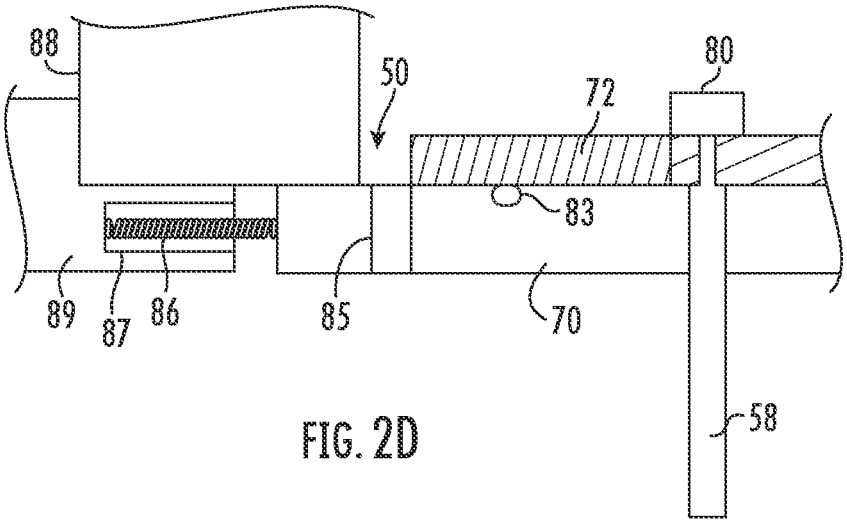
FIG. 2D schematically illustrates the mechanical coupling of FIG. 2C with the ring in a second position.
Figure 2E:
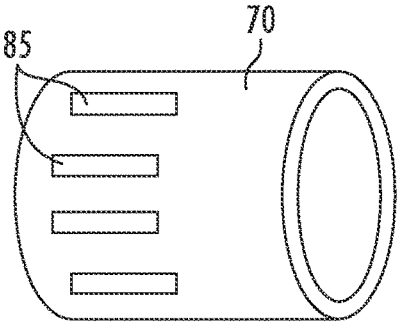
FIG. 2E schematically illustrates an example moveable ring.

FIG. 2C schematically illustrates an example mechanical coupling between an inlet guide vane 58 and the ring 70. The ring 70 has a set of coil springs 86 (e.g., 4 or 6) attached that contact the ring 70 at one end and are disposed at an opposing end in a recess 87 of a recessed ring 89 that is bolted to portion 88 of the housing 40. An o-ring 83 provides a seal between the ring 70 and wall 72. The ring 70 has openings 85 that axially align with the second opening 50 when the guide vanes 58 are in full open position (see FIG. 2C). The springs 86 push the ring 70 against the guide vane 58. When the guide vanes 58 close (see FIG. 2D), the springs 86 move the ring 70 axially as shown in FIGS. 2C-D. FIG. 2E illustrates an example ring which includes a plurality of openings 85 that are circumferentially spaced apart from each other around the ring 70. Of course, it is understood that other types of mechanical couplings could be used in which rotation of the inlet guide vanes 58 provides axial movement of the ring 70 along the longitudinal axis A could be used, such as those of FIGS. 3 and 4A-B.

The inlet guide vanes 58 are rotatable to control flow to the impeller 56. In the example of FIGS. 2A-B, as the inlet guide vanes 58 rotate to reduce flow to the impeller 56, the ring 70 moves towards the first position to decrease obstruction of the second opening 50, and as the inlet guide vanes 58 rotate to increase flow to the impeller 56, the ring 70 moves towards the second position to increase obstruction to the second opening 50.

Actuators 80 provide for rotation of the inlet guide vanes 58. The actuators 80 are in communication with the controller 82. The controller 82 is configured to move the ring 70 between the first and second positions by rotating the inlet guide vanes 58 based on a load level of the centrifugal compressor 22. The controller 82 receives pressure information from a pressure sensor 84A in the inlet chamber 44, a pressure sensor 84B in the collector 62, and optionally also a speed sensor 84C that measures a rotational speed of the shaft 66. In one example, the motor 64 rotates the shaft 66 at a fixed constant speed and the speed sensor 84C is omitted.

The controller 82 uses the sensor readings from the sensors 84A-C and a rotational angle of the inlet guide vanes 58 to determine a load of the centrifugal compressor 22. In one example, as part of its load calculations, the controller 82 determines a ratio between pressure readings of the pressure sensors 84A and 84B and determines a mass of flow to the impeller 56 based on an angle of the inlet guide vanes 58 and a rotational speed of the impeller 56. In one example, the controller 82 moves the ring 70 towards the first position to decrease obstruction to the second opening 50 at lower load levels and moves the ring 70 towards the second position to increase obstruction to the second opening 50 at higher load levels.

Figure 2F:
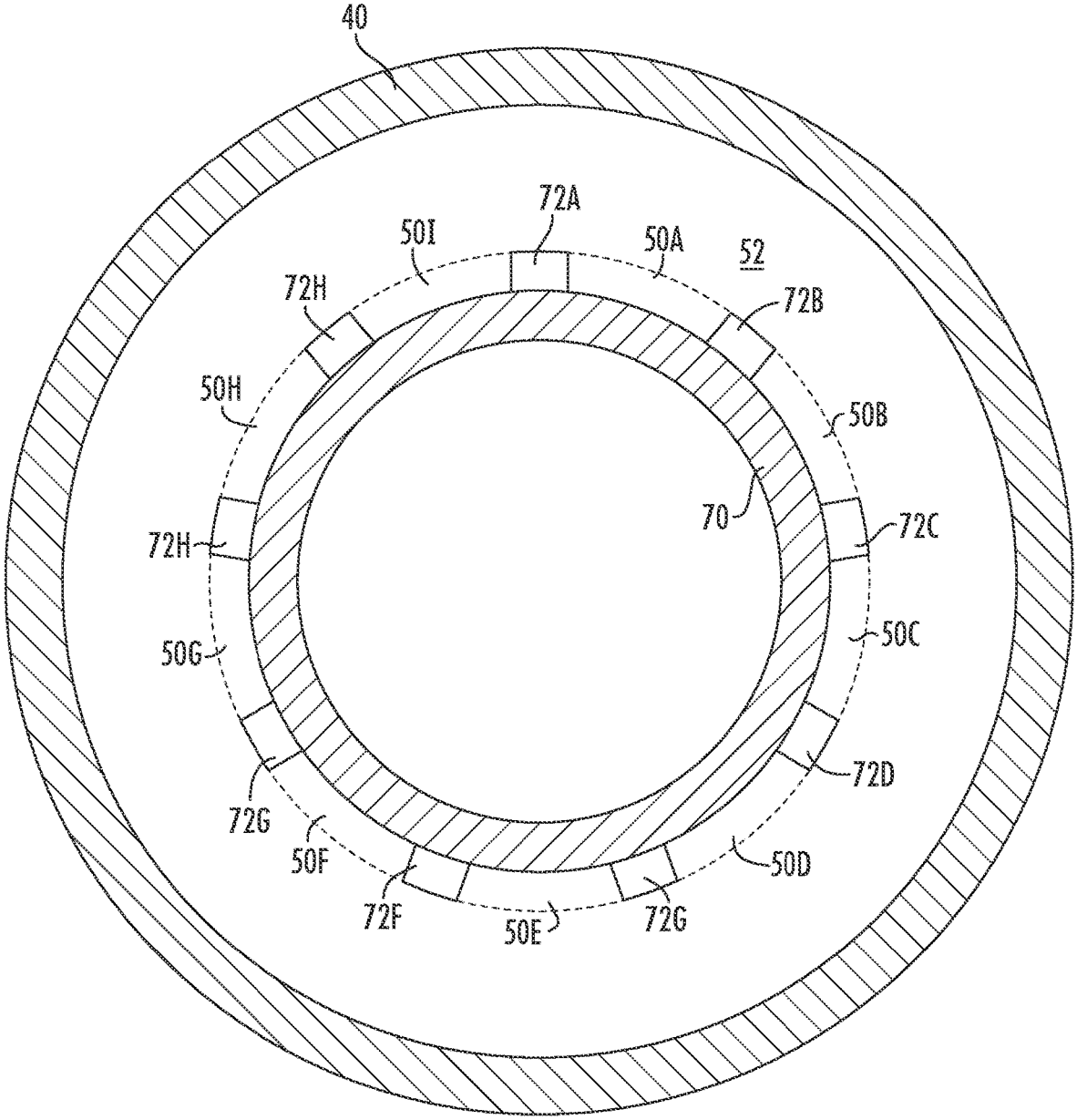
FIG. 2F schematically illustrates an example cross section of the centrifugal compressor of FIG. 2B taken along line C-C.

FIG. 2F schematically illustrates an example cross section of the centrifugal compressor 22 taken along line C-C in FIG. 2B. In the example of FIG. 2C, the second opening 50 comprises a plurality of curved slots 50A-I that are separated by wall portions 72A-H of the wall 72. The wall portions 72A-H connect the wall 72 to a front portion 88 of the housing 40. The opening 48 can be configured in a similar fashion as a plurality of curved slots separated by connecting portions that connect the two portions 45A-B of the ported shroud 45 to each other.

In this disclosure, like reference numerals designate like elements where appropriate and reference numerals with the addition of one-hundred or multiples thereof designate modified elements that are understood to incorporate the same features and benefits of the corresponding elements.

Figure 3:
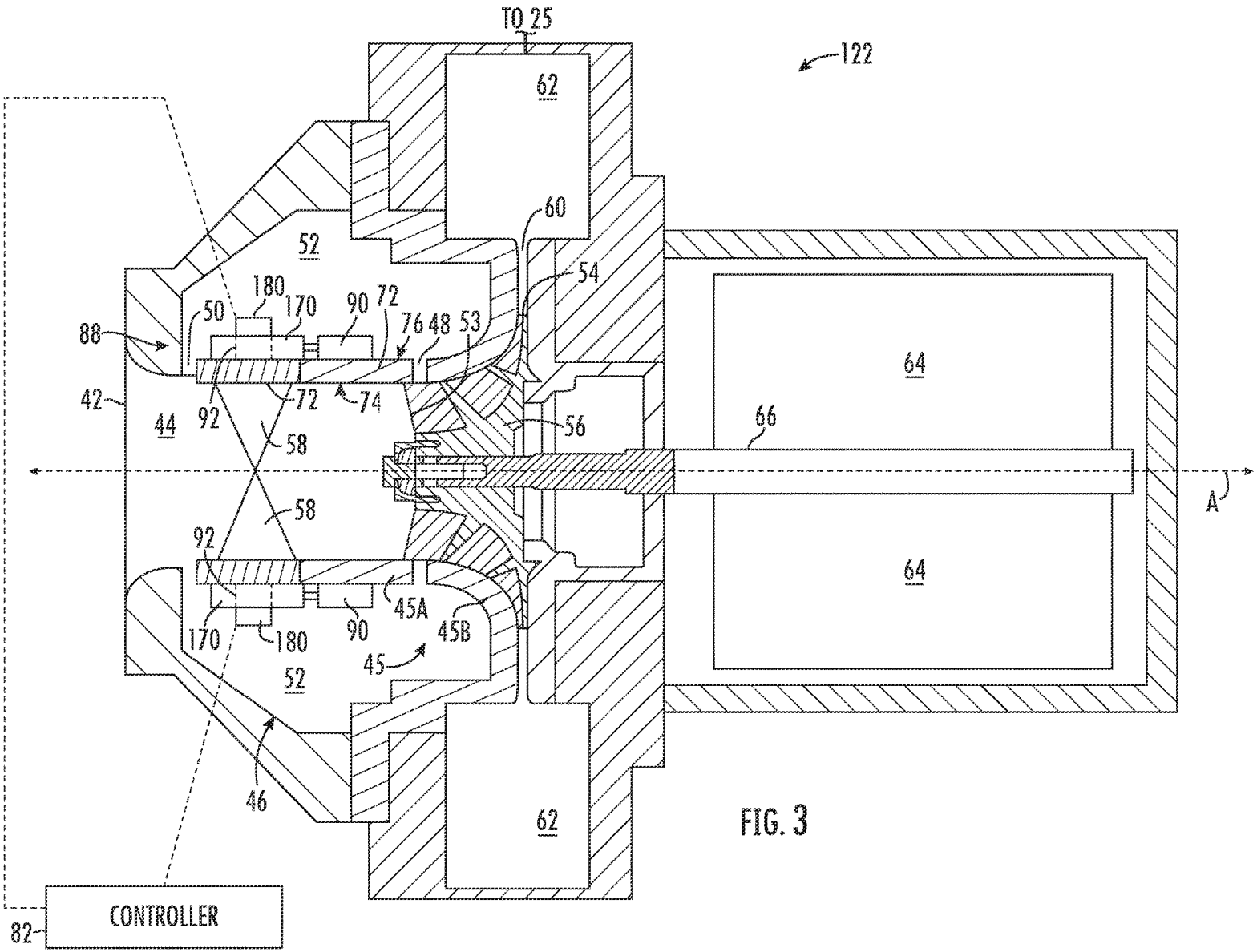
FIG. 3 schematically illustrates an example centrifugal compressor having another control arrangement for a ring.

FIG. 3 schematically illustrates an example centrifugal compressor 122 having another control arrangement for a ring 170. In the example of FIG. 3, the ring 170 resides radially outward of the inlet chamber 44 and wall 72, and abuts a radially outer side 76 of the wall 72 in the recirculation passage 52. The ring 170 is axially movable between a first position (shown in FIG. 3) in which the ring 170 is axially between openings 48, 50 to a closed position where the ring 170 partially or fully obstructs the opening 50 along the radially outer side 76 of the wall 72. A plurality of actuators 90 are situated in the ported shroud 45 and are circumferentially spaced apart from each along the radially outer side 76 of the wall 72. In one example, each of the actuators is located at a same axial position, and optionally the actuators 90 are evenly circumferentially spaced apart from each other.

The actuators 90 work cooperatively to evenly apply force to the ring 170 for moving the ring towards the front portion 88 or away from the front portion 88. Controller 82 is operatively connected to the actuators 90 for controlling their operation based on one or more sensors 84 (not shown), such as the pressure sensors 84A-B and optionally also speed sensor 84C shown in FIGS. 2A-B. Actuators 180 are configured to rotate the inlet guide vanes 58. In the example of FIG. 3, the actuators 180 extend through openings 92 in the ring 170.

Figure 4A:
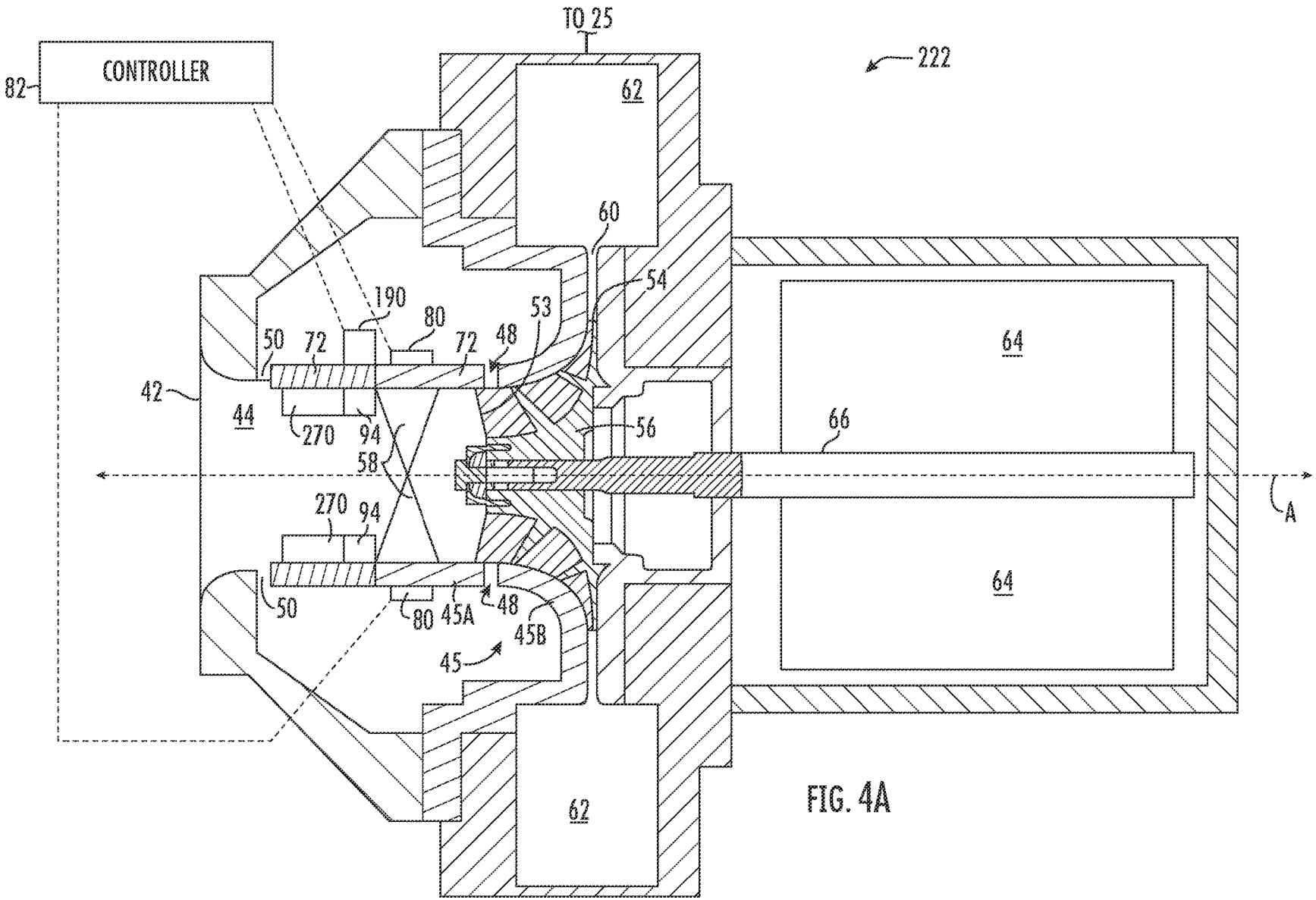
FIG. 4A schematically illustrates an example centrifugal compressor having another control arrangement for a ring.

FIG. 4A schematically illustrates an example centrifugal compressor 222 having another control arrangement for a ring 270. In this example, an actuator 190 rotates a ring 94 that is separate from the ring 270 to axially move the ring 270.

Figure 4B:
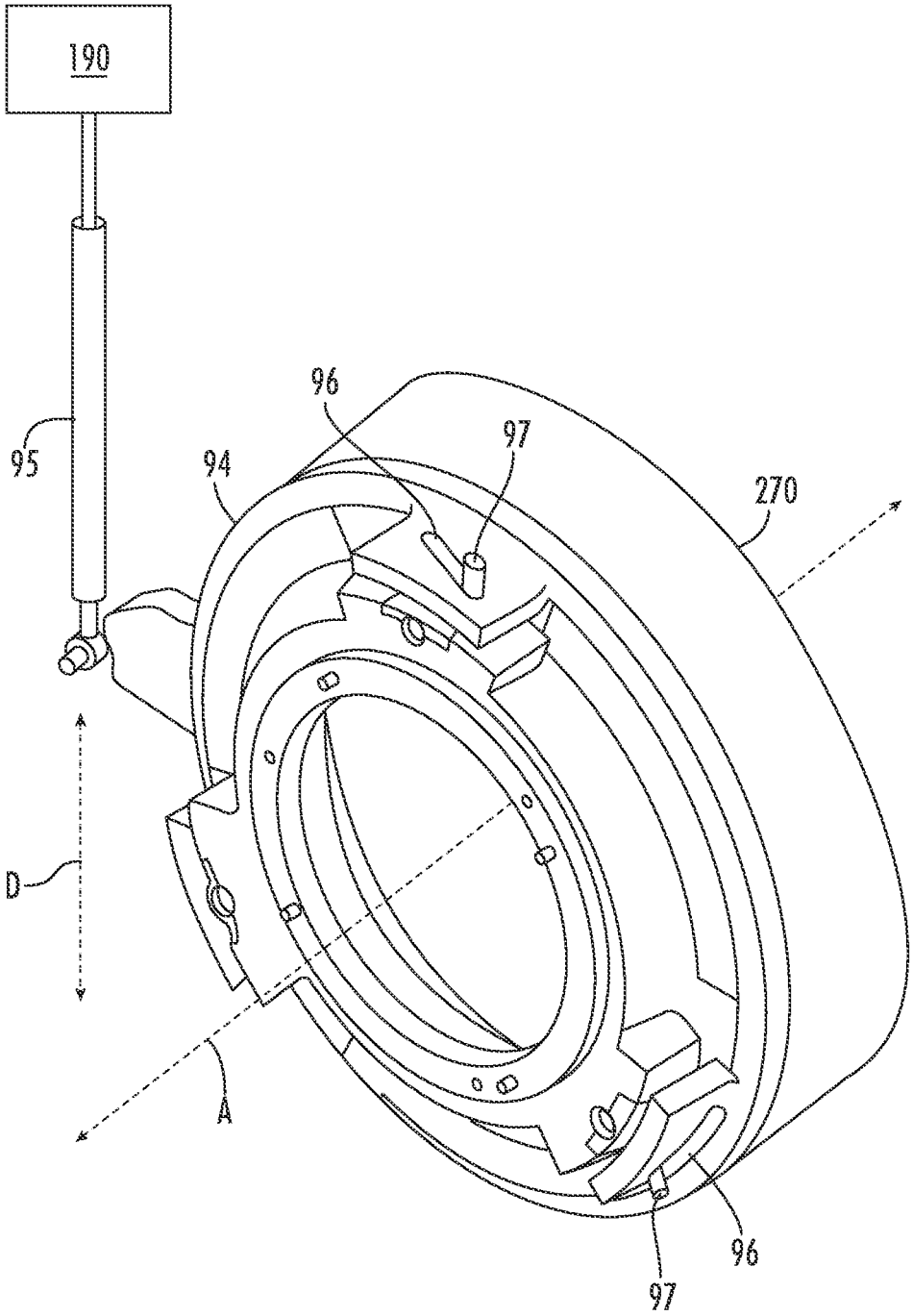
FIG. 4B is a schematic view of an example actuator configuration for the control arrangement of FIG. 4A.

FIG. 4B illustrates an example of the actuator 190 and ring 94 in greater detail. The actuator 190 is operable to extend and retract a rod 95 that in turn rotates the ring 94 about the longitudinal axis A. The rod 95 extends along a longitudinal axis D that is non-parallel to the longitudinal axis A. The ring 94 includes a plurality of cam surfaces which in the example of FIG. 4B are slots 96 that are sloped, and the ring 270 includes a plurality of cam members which in the example of FIG. 4B include radially extending cam follower pins 97, each situated within a respective one of the cam slots 96. The actuator 190 is configured to rotate the ring 94 about the longitudinal axis A, which translates the cam follower pins 97 through their respective cam slots 96 and provides axial movement of the ring 270 along the longitudinal axis A.

Controller 82 is operatively connected to the actuator 190 for controlling operation of the actuator 190 based on one or more sensors 84 (not shown), such as the pressure sensors 84A-B and optionally also speed sensor 84C shown in FIGS. 2A-B.

In one example, the controller 82 is configured to move the ring 170 between the first and second positions when the inlet guide vanes 58 move, even if the inlet guide vanes 58 are not mechanically coupled to the ring 170.

Figure 5:
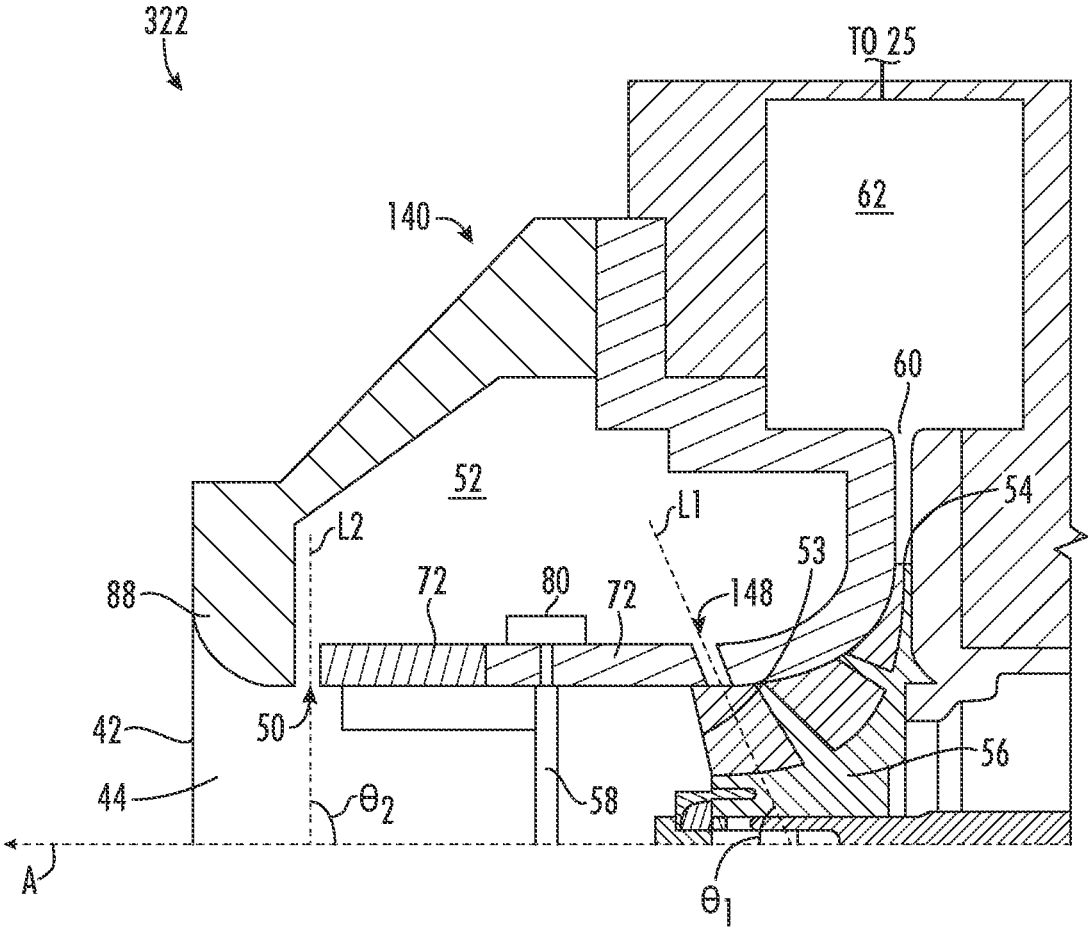
FIG. 5 schematically illustrates an example centrifugal compressor with a sloped opening.

FIG. 5 schematically illustrates an example centrifugal compressor 322 housing 140 includes opening 148 that is sloped with respect to the opening 50. Opening 148 extends along line L1 at an angle of $\theta_1$ with respect to the central longitudinal axis A, and opening 50 extends along line L2 at an angle of $\theta_2$ with respect to the central longitudinal axis A. In the example of FIG. 5, Line L1 is non-parallel to line L2, and line L2 is sloped towards line L1 radially outward of the central longitudinal axis A. In one example, $\theta_1$ is approximately 90° and $O_2$ is approximately 60°. Although the ring 70 is omitted from FIG. 5, it is understood that it could be included in one example. Also, the sloped line L1 could be included in any of the other embodiments disclosed herein.

In one example the refrigerant that is utilized in the refrigeration cycle is compressed by the centrifugal compressor 322 (or any of the other compressors discussed above) is approximately 98-99% vapor and approximately 1-2% liquid, and has a density that is approximately 5 times greater than air.

Figure 6A:
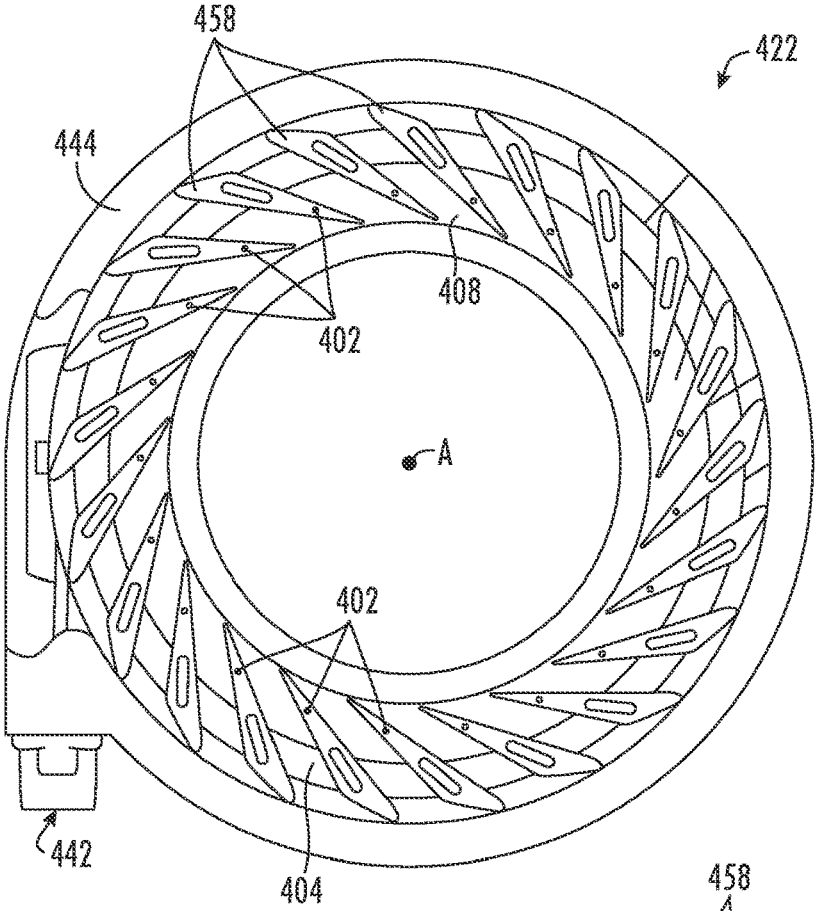
FIG. 6A schematically illustrates an example centrifugal compressor with radial inlet guide vanes in an open position.

Although the inlet guide vanes depicted in FIGS. 1-5 are axial inlet guide vanes, a ring could also be used to selectively restrict a recirculation passage in connection with radial inlet guide vanes. FIG. 6A schematically illustrates an example centrifugal compressor 422 with radial inlet guide vanes 458 in an open position. Fluid is drawn in through inlet 442 into an inlet chamber 444 and passes between the inlet guide vanes 458 that are in the open position into a passage 408. The radial inlet guide vanes 458 pivot along axes 402 based on rotation of a ring 404. An impeller (not shown in FIG. 6A) rotates about longitudinal axis A that is parallel to the axes 402.

Figure 6B:
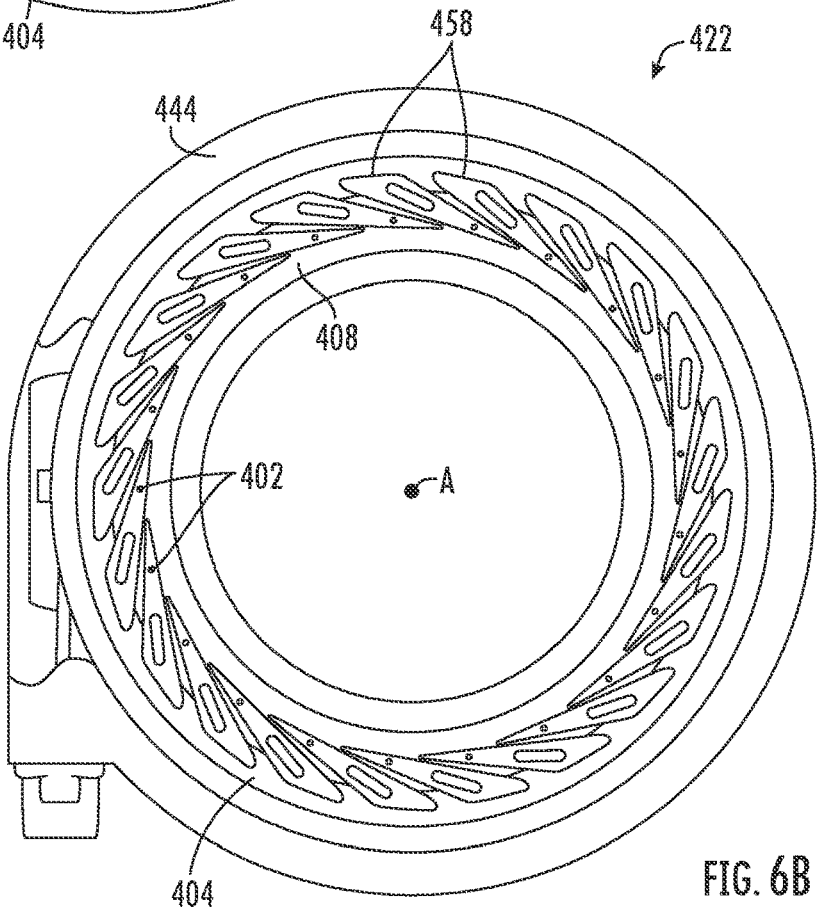
FIG. 6B schematically illustrates the centrifugal compressor of FIG. 6A with the radial inlet guide vanes in a closed position.

FIG. 6B schematically illustrates the centrifugal compressor 422 with the radial inlet guide vanes 458 in a closed position, in which a flow of fluid from the chamber 444 to the inlet 408 is more restricted.

Figure 6C:
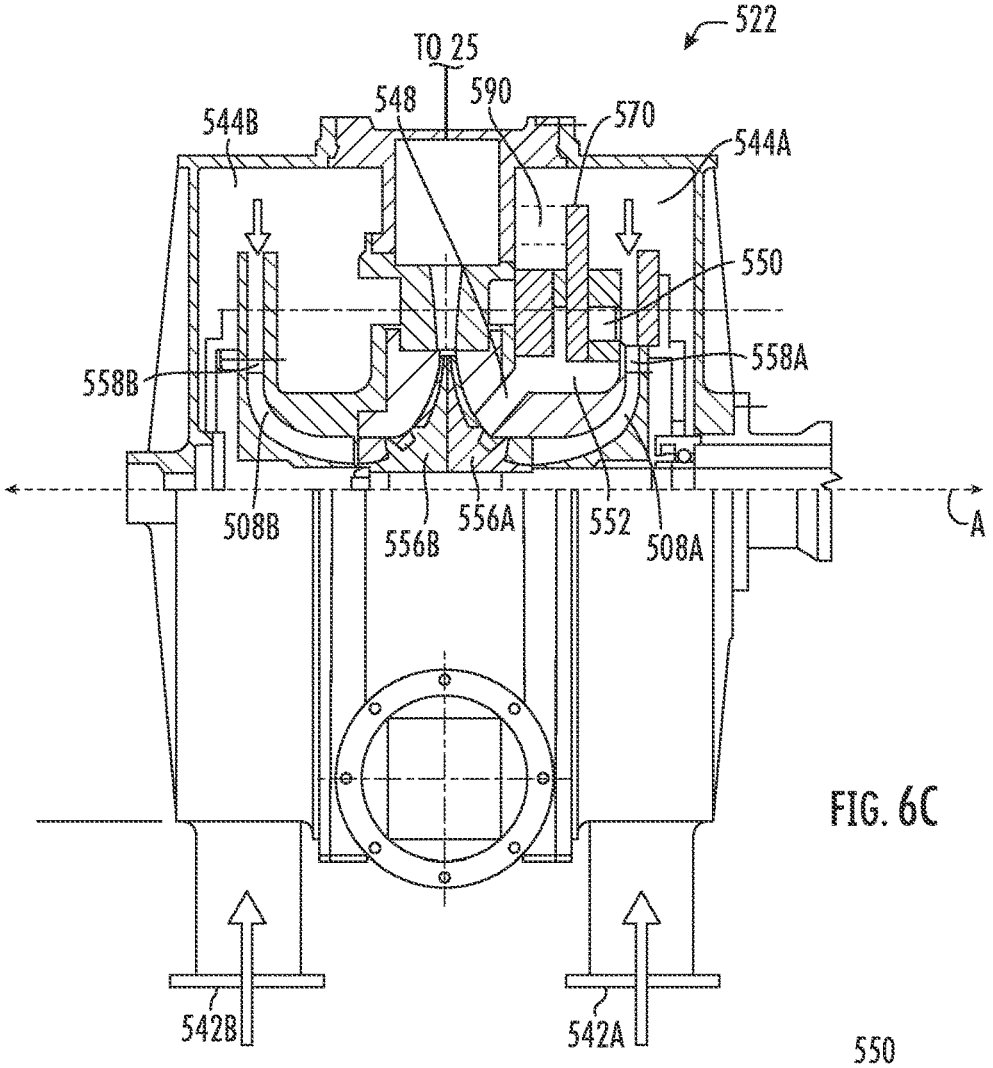
FIG. 6C illustrates an example centrifugal compressor that utilizes radial inlet guide vanes and a recirculation passage.

FIG. 6C illustrates an example centrifugal compressor 522 that includes radial inlet guide vanes 558A-B, a recirculation passage 552, and back to back impellers 556A-B. Impeller 556A draws fluid through inlet 542A, into inlet chamber plenum 544A, and past radial inlet guide vanes 558A into an inlet 508A. Impeller 556B draws fluid through inlet 542B, into inlet chamber 544B, and past radial inlet guide vanes 558B into inlet 508B. The passage 508A includes a plurality of first openings 548 that are circumferentially spaced apart from each other around longitudinal axis A, and a plurality of second openings 550 that are circumferentially spaced apart from each other around longitudinal axis A. The first openings 548 and second openings 550 define one or more recirculation passages 552 for circulating fluid from the inlet 508B back to the inlet chamber 544A. A ring 570 is rotatable to selectively obstruct the second openings 550. An actuator 590 provides for rotation of the ring 570.

Figure 6D:
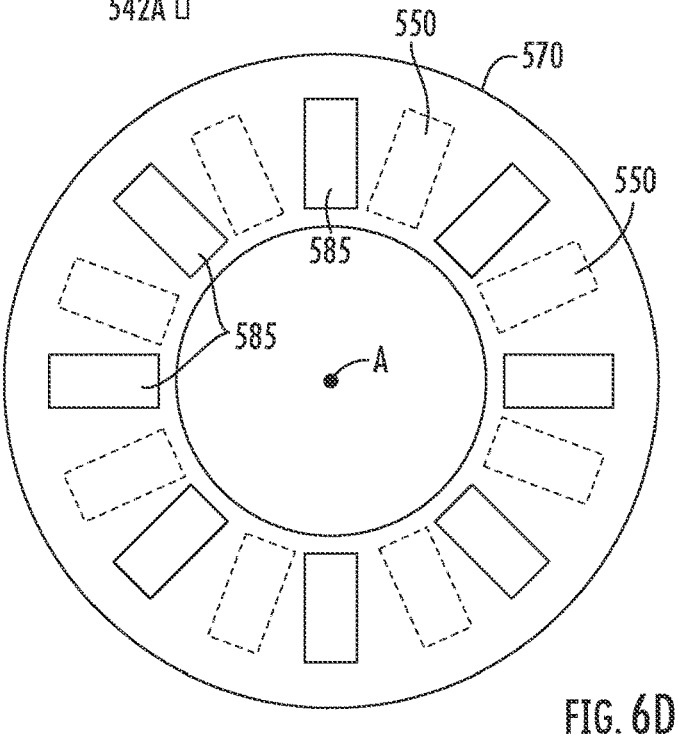
FIG. 6D schematically illustrates an example ring for selectively restricting an opening of the recirculation passage of FIG. 6C.

FIG. 6D schematically illustrates an example of the ring 570 which includes a plurality of openings 585. The ring is rotatable about longitudinal axis A between a first position and a second position, which is shown in FIG. 6D. The ring 570 acts as a shutter by selectively increasing alignment of the openings 585 with the second openings 550 in the first position to increase fluid flow in the recirculation passage 552, and selectively decreasing alignment of the openings 585 with the second openings 550 to restrict fluid flow in the recirculation passage 552 in the second position. In the example second position of FIG. 6D, the openings 585 are misaligned with the second openings 550, providing maximum obstruction of the second openings 550, and minimal flow in the one or more recirculation passages 552. In the first position (not shown), the openings 550 are at least partially aligned with the second openings 550. Thus, the ring 570 obstructs the second openings 550 more in the second position than in the first position.

Figure 7:
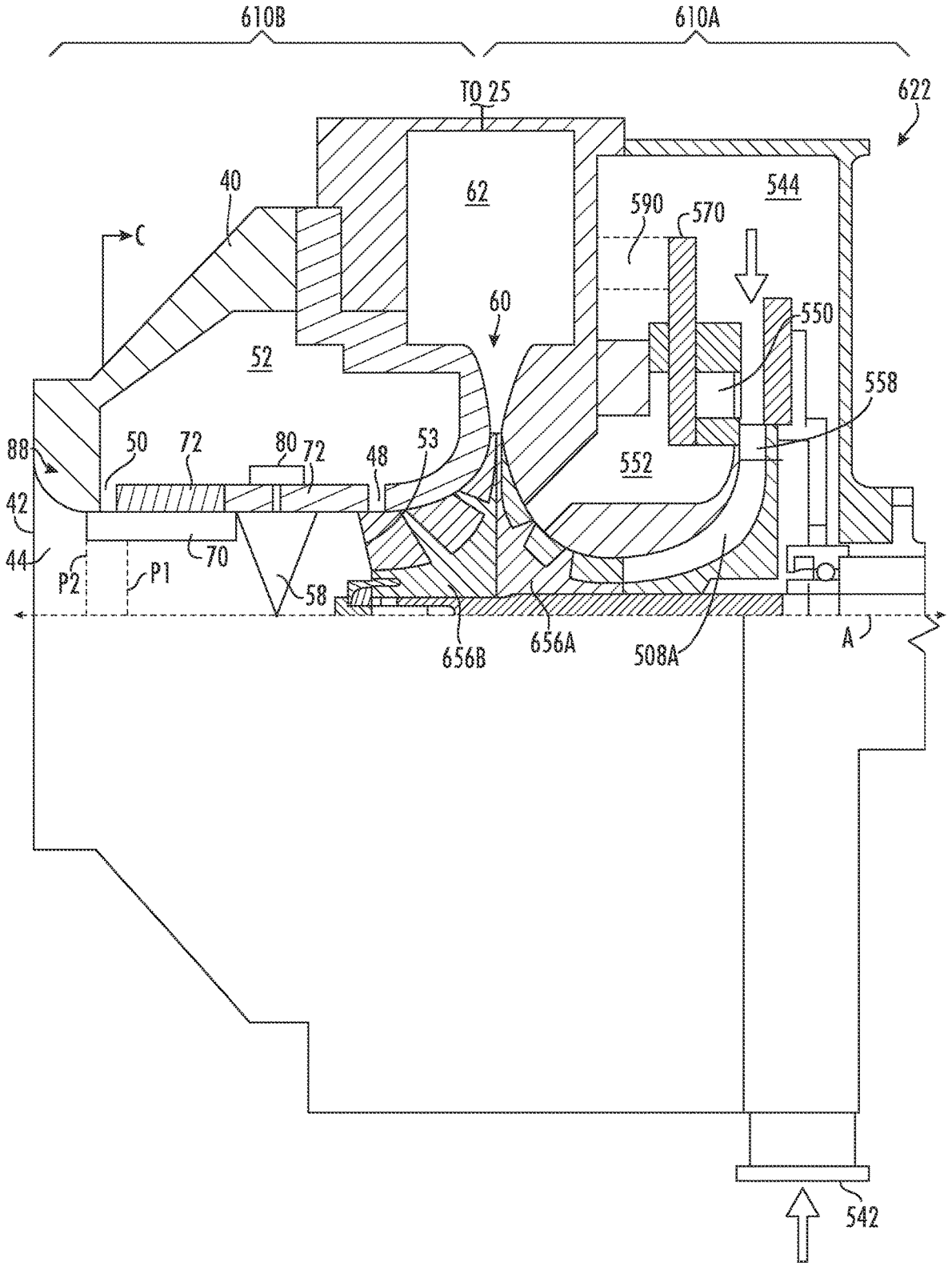
FIG. 7 schematically illustrates a compressor that includes multiple inlet chambers and both axial and radial inlet guide vanes.

FIG. 7 schematically illustrates an example centrifugal compressor 622 that includes multiple portions 610A, 610B that combines aspects of the centrifugal compressor 522 of FIG. 6C (portion 610A) with aspects of the centrifugal compressor 22 of FIG. 2B (portion 610B). The centrifugal compressor 622 includes multiple inlet chambers 44, 544, multiple recirculation passages 52, 552, and includes both axial inlet guide vanes 58 and radial inlet guide vanes 558. Ring 70 is movable axially along longitudinal axis A to control a level of obstruction of opening 50, and ring 570 is rotatable about longitudinal axis A to control a level of obstruction of opening 550.

Impeller 656, which includes impeller portions 656A-B, rotates about the longitudinal axis A. Impeller portion 656A is configured to draw fluid through inlet 542 into the inlet chamber 544, and impeller portion 656B is configured to draw fluid through inlet 44 into inlet chamber 44. The same diffuser passage 60 and collector 62 are used by each centrifugal compressor portion 610A-B.

Figure 8:
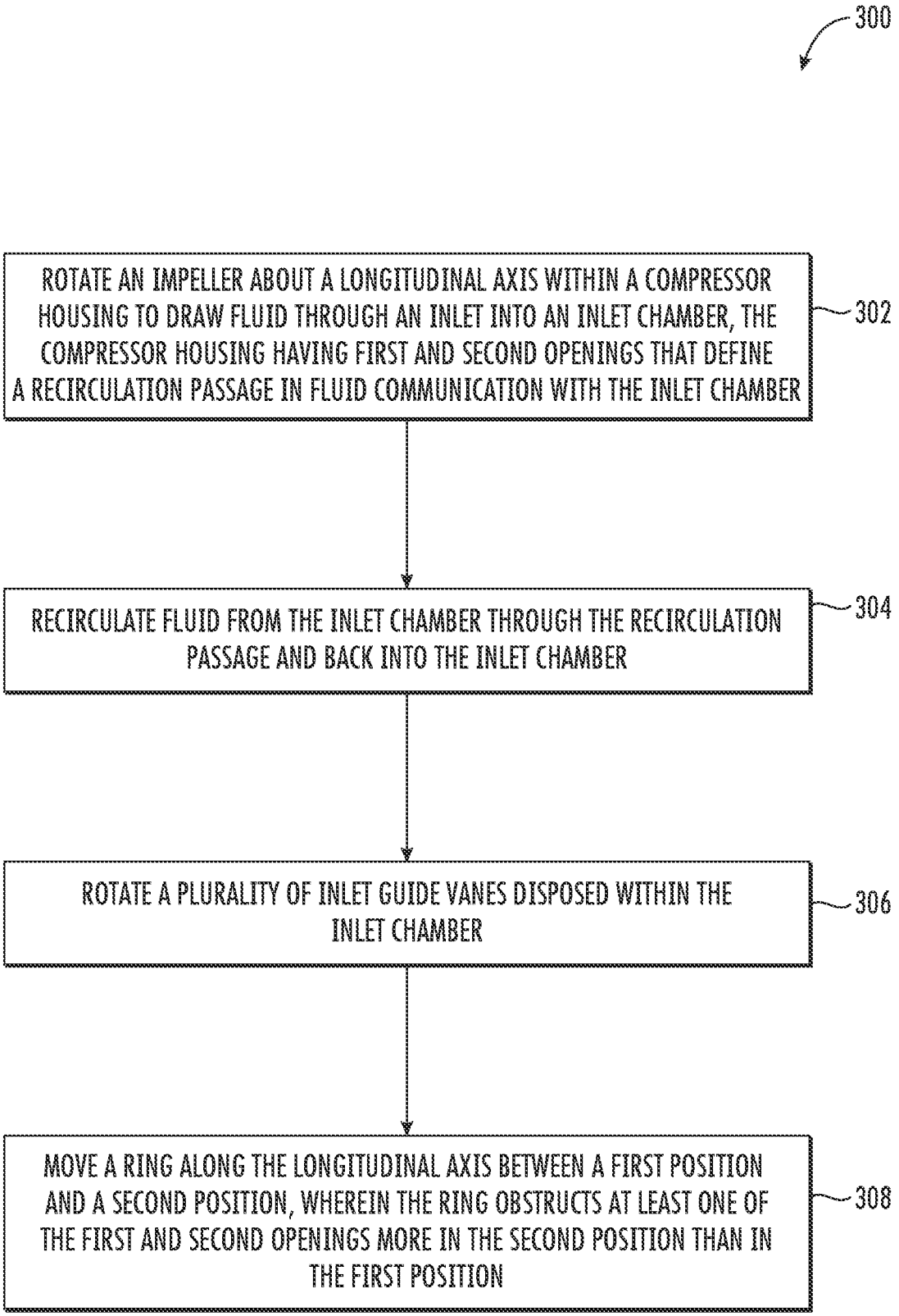
FIG. 8 schematically illustrates an example method of operating a centrifugal compressor.

FIG. 8 schematically illustrates an example method 300 of operating a centrifugal compressor 22. An impeller 56 is rotated about longitudinal axis A within housing 40 to draw fluid into inlet chamber 44 (block 302). The housing 40 has first and second openings 48, 50 that define a recirculation passage 52 in fluid communication with the inlet chamber 44. Fluid from the inlet chamber 44 is recirculated through the recirculation passage 52 and back into the inlet chamber 44 (block 304). Inlet guide vanes 58 are rotated (block 306). Ring 70 is moved along the longitudinal axis A between a first position (see, e.g., FIG. 2A) and a second position (see, e.g., FIG. 2B) (block 308) during the rotation of the inlet guide vanes 58. The ring 70 obstructs the second opening 50 more in the second position than in the first position. Surge is detected by measuring current, pressure, or vibration input. When a surge event occurrence is detected at a given inlet guide vane position, the ring 70 will be moved independently to bring the compressor to operate in a stable manner.

The variable ported shroud embodiments discussed herein provide improved stability and minimized surge conditions at partial compressor loads without imposing the efficiency penalty typically associated with a ported shroud at higher loads, because at higher loads the ring 70 obstructs one of the openings 48, 50 and prevents the level of recirculation that would otherwise occur. By linking movement of the guide vanes 58 to movement of the ring 70, the compressor 22 is able to avoid surge conditions at lower loads and avoid the efficiency penalty that would otherwise be provided by an open recirculation passage 52 at higher loads.

Although the centrifugal compressor 22 has been discussed in the context of a refrigeration circuit 20, it is understood that the centrifugal compressor 22 is not limited to refrigeration circuits 20, and could be used for other applications such as a turbocharger or propulsion engine.

Also, although the centrifugal compressor 22 is depicted and described herein as having a single impeller 56 in a single stage design, it is understood that additional impeller stages could be used that also rotate about the same longitudinal axis A.

Also, although FIGS. 2A-B, 3 and 4A depict ring 70, 170, 270 within a particular one of the inlet chamber 44 and the recirculation passage 52, it is understood that these are non-limiting examples and that the rings 70, 170, 270 could be disposed in another of the inlet chamber 44 and recirculation passage 52 in other embodiments. Likewise, the actuators 90 could be situated in the recalculation passage 52 instead of in the inlet chamber 44 in an embodiment.

An example centrifugal compressor includes a housing that defines an inlet chamber and includes first and second openings that define a recirculation passage in fluid communication with the inlet chamber. An impeller is disposed within the housing and is rotatable about a longitudinal axis to draw fluid into the inlet chamber. The first and second openings are at different axial locations along the longitudinal axis. A plurality of inlet guide vanes are rotatable and situated in the inlet chamber. The centrifugal compressor includes a ring and a controller for moving the ring along the longitudinal axis between a first position and a second position when rotating the inlet guide vanes. The ring obstructs at least one of the first and second openings more in the second position than in the first position.

An example method of operating a centrifugal compressor includes rotating an impeller about a longitudinal axis within a compressor housing to draw fluid into an inlet chamber. The compressor housing includes first and second openings that define a recirculation passage in fluid communication with the inlet chamber. Fluid from the inlet chamber is recirculated through the recirculation passage and back into the inlet chamber. A plurality of inlet guide vanes disposed within the inlet chamber are rotated. A ring is moved along the longitudinal axis between a first position and a second position during said rotating, wherein the ring obstructs at least one of the first and second openings more in the second position than in the first position.

An example centrifugal compressor 322 includes a housing 140 that defines an inlet chamber 44 and includes a first opening 148 and a second opening 50 that define a recirculation passage 52 in fluid communication with the inlet chamber 44. An impeller 56 within the housing 140 is rotatable about longitudinal axis A to draw refrigerant into the inlet chamber 44. The first opening 148 and second opening 50 are at different axial locations along the longitudinal axis A.

Although example embodiments have been disclosed, a worker of ordinary skill in this art would recognize that certain modifications would come within the scope of this disclosure. For that reason, the following claims should be studied to determine the scope and content of this disclosure.

What is claimed is:

1. A centrifugal compressor, comprising:

a housing defining an inlet chamber and including at least one first opening and at least one second opening, the at least one first opening and at least one second opening defining a recirculation passage in fluid communication with the inlet chamber;

an impeller within the housing and rotatable about a longitudinal axis to draw fluid into the inlet chamber;

a first ring including at least one ring opening;

a plurality of radial inlet guide vanes that are situated in the inlet chamber and are rotatable about respective axes from an open position to a closed position, wherein the plurality of radial inlet guide vanes restrict a flow of the fluid from the inlet chamber to the outlet passage more in the closed position than in the open position;

a second ring; and a controller configured to:

rotate the first ring about the longitudinal axis between a first position and a second position to control a flow of fluid through the recirculation passage, wherein the first ring obstructs at least one of the first and second openings more in the second position than in the first position; and rotate the plurality of radial inlet guide vanes about their respective axes based on rotation of the second ring about the longitudinal axis.

2. The centrifugal compressor of claim 1, wherein:

the at least one ring opening includes a plurality of ring openings that are circumferentially spaced apart from each other about the longitudinal axis;

the at least one second opening includes a plurality of second openings that are circumferentially spaced apart from each other about the longitudinal axis; and the plurality of ring openings and the plurality of second openings are more aligned, and the plurality of second openings are thereby less obstructed, in the first position than in the second position.

3. The centrifugal compressor of claim 1, wherein the at least one ring opening extends through the first ring.

4. The centrifugal compressor of claim 1, comprising:

a pressure sensor, wherein the controller is configured to rotate the first ring based on measurements from the pressure sensor.

5. The centrifugal compressor of claim 1, wherein the centrifugal compressor is part of a refrigeration circuit, and the fluid drawn into the inlet chamber by the impeller is refrigerant.

6. A method of operating a centrifugal compressor comprising:

rotating an impeller about a longitudinal axis within a compressor housing to draw fluid into an inlet chamber, the compressor housing having at least one first opening and at least one second opening, the at least one first opening and the at least one second opening defining a recirculation passage in fluid communication with the inlet chamber;

recirculating fluid from the inlet chamber through the recirculation passage and back into the inlet chamber; and rotating a first ring about the longitudinal axis between a first position and a second position to control a flow of fluid through the recirculation passage, wherein the first ring obstructs at least one of the first and second openings more in the second position than in the first position;

wherein:

the centrifugal compressor comprises a plurality of radial inlet guide vanes that are situated in the inlet chamber and are rotatable about respective axes from an open position to a closed position, wherein the plurality of radial inlet guide vanes restrict a flow of the fluid from the inlet chamber to an outlet passage more in the closed position than in the open position; and the method comprises rotating the plurality of radial inlet guide vanes about their respective axes based on rotation of a second ring about the longitudinal axis.

7. The method of claim 6, wherein:

the at least one ring opening includes a plurality of ring openings that are circumferentially spaced apart from each other about the longitudinal axis;

the at least one second opening includes a plurality of second openings that are circumferentially spaced apart from each other about the longitudinal axis; and the plurality of ring openings and the plurality of second openings are more aligned, and the plurality of second openings are thereby less obstructed, in the first position than in the second position.

8. The method of claim 6, wherein the at least one ring opening extends through the first ring.

9. The method of claim 6, comprising:

measuring a pressure of the fluid; and performing said rotating of the first ring based on fluid measurements from said measuring.

10. The method of claim 6, wherein the centrifugal compressor is part of a refrigeration circuit, and the fluid drawn into the inlet chamber by the impeller is refrigerant.

* * * * *